US009629403B2

(12) United States Patent
Arena

(10) Patent No.: US 9,629,403 B2
(45) Date of Patent: Apr. 25, 2017

(54) METHOD OF SECURING AND ALIGNING A NECKTIE ON A SHIRT

(71) Applicant: Angelo Arena, New York, NY (US)

(72) Inventor: Angelo Arena, New York, NY (US)

( * ) Notice: Subject to any disclaimer, the term of this patent is extended or adjusted under 35 U.S.C. 154(b) by 0 days.

(21) Appl. No.: 14/852,961

(22) Filed: Sep. 14, 2015

(65) Prior Publication Data

US 2017/0071274 A1 Mar. 16, 2017

(51) Int. Cl.
*A41D 25/00* (2006.01)

(52) U.S. Cl.
CPC ..... *A41D 25/003* (2013.01)

(58) Field of Classification Search
CPC ..... A41D 25/00; A41D 25/003
USPC ..... 2/145–151, 152.1, 153–157; 24/54, 65, 24/66.1
See application file for complete search history.

(56) References Cited

U.S. PATENT DOCUMENTS 1,239,746 A * 9/1917 Tobie ..... A44B 6/00 2/145
2,652,569 A * 9/1953 Confino ..... A41D 25/003 2/145
2,738,513 A * 3/1956 Carty ..... A41D 25/003 2/145
3,474,503 A * 10/1969 Less ..... A44B 6/00 2/145
4,827,576 A * 5/1989 Prince, Jr. ..... A44B 6/00 2/145
4,835,821 A * 6/1989 Durante ..... A41D 25/003 2/144
4,920,579 A * 5/1990 Swain ..... A41D 25/003 2/145
4,972,523 A * 11/1990 Begg ..... A41D 25/003 2/137
5,245,708 A * 9/1993 Campelia ..... A41D 25/003 2/145
5,315,713 A * 5/1994 Pileggi ..... A41D 25/003 2/144
5,353,438 A * 10/1994 Voiles ..... A41D 25/003 2/145
5,815,836 A * 10/1998 Jacobson, II ..... A41D 25/003 2/144
6,131,200 A * 10/2000 McNamara ..... A41D 25/003 2/144
6,182,292 B1 * 2/2001 Knoll ..... A41B 1/10 2/115
7,346,934 B1 * 3/2008 Scott ..... A41D 25/003 2/145
2008/0034465 A1 * 2/2008 Pfanner ..... A41D 25/003 2/145
2008/0148463 A1 * 6/2008 Vaughn ..... A41D 25/003 2/145

(Continued)

*Primary Examiner* — Joshua Rodden

(57) ABSTRACT

The present invention relates to a method of securing and aligning a necktie on a shirt. The method includes an object with flexible material loops protruding from two sides of the object. The object is put through a necktie loop located on the rear portion of a necktie and remains in this position while the flexible material loops are then attached to the two closest buttons on a shirt. This method secures a necktie to a shirt, whereby ensuring that a necktie remains vertically aligned over the buttons on a shirt, while at the same time the invention remains hidden from view while in use.

2 Claims, 2 Drawing Sheets

(56) References Cited

U.S. PATENT DOCUMENTS

| | | | | |
|---|---|---|---|---|
| 2008/0201910 | A1* | 8/2008 | Schoening | A41D 25/003 24/66.1 |
| 2008/0307558 | A1* | 12/2008 | Littlejohn | A41D 25/003 2/145 |
| 2010/0115734 | A1* | 5/2010 | Wilson | A41D 25/003 24/56 |
| 2012/0266354 | A1* | 10/2012 | Clough | A41D 25/003 2/129 |
| 2012/0324678 | A1* | 12/2012 | Dronia | A44B 6/00 24/66.1 |
| 2015/0359299 | A1* | 12/2015 | Castro | A44B 6/00 24/66.7 |

* cited by examiner

METHOD OF SECURING AND ALIGNING A NECKTIE ON A SHIRT

TECHNICAL FIELD

The present invention relates to a method of securing and aligning a necktie on a shirt.

BACKGROUND OF THE INVENTION

Neckties are worn daily by tens of thousands of individuals and for many different purposes, which include business and pleasure. When wearing a necktie, the portrayal of a professional appearance is paramount. Such a portrayal of professional appearance can quickly be ruined if, for example, a necktie begins to blow around due to wind or appear unaligned over one's shirt buttons. Additionally, the wearer of a necktie frequents the unfortunate occasion of having their necktie become soiled as a result of whenever the wearer leans forward, the necktie advances forward indiscriminately.

There is a need for a method of securing and aligning a necktie to a shirt, allowing for a necktie to display its true character without gaudy metal clips or bars, while ensuring that the necktie is always secured and aligned in a vertical manner along the shirt's length. It is especially desirable to develop a necktie securing mechanism that is hidden from view when worn.

BRIEF SUMMARY OF THE INVENTION

The present disclosure provides a method of securing and aligning a necktie on a shirt.

According to the invention, the method of securing and aligning a necktie on a shirt is completed by first tying a necktie using any standard method. Second, one should put the narrow end taper of the tie through the tie loop located on the reverse side of the wide end taper of the tie. Third, one should place the invention through the necktie loop. Fourth, the invention is then to be attached to the two closest buttons on one's shirt.

The method includes the use of an object with flexible material protruding from its ends along its widths, creating loops. The object passes through the necktie loop located on the rear portion of the necktie and remains in-between the necktie loop and the necktie, while the flexible material loops protruding from the object are then attached to the two shirt buttons nearest to the necktie loop. In doing so, the invention securely fastens one's necktie to their shirt and aligns the necktie to ensure that it aligns vertically over the buttons of a shirt. Further, the invention remains hidden from view while the method is in use.

The accompanying drawings, which are incorporated in and form a part of the specification, illustrate the preferred embodiment of the present invention, and together with the description, serve to explain the principles of the invention.

DETAILED DESCRIPTION OF THE INVENTION

Figure 1:
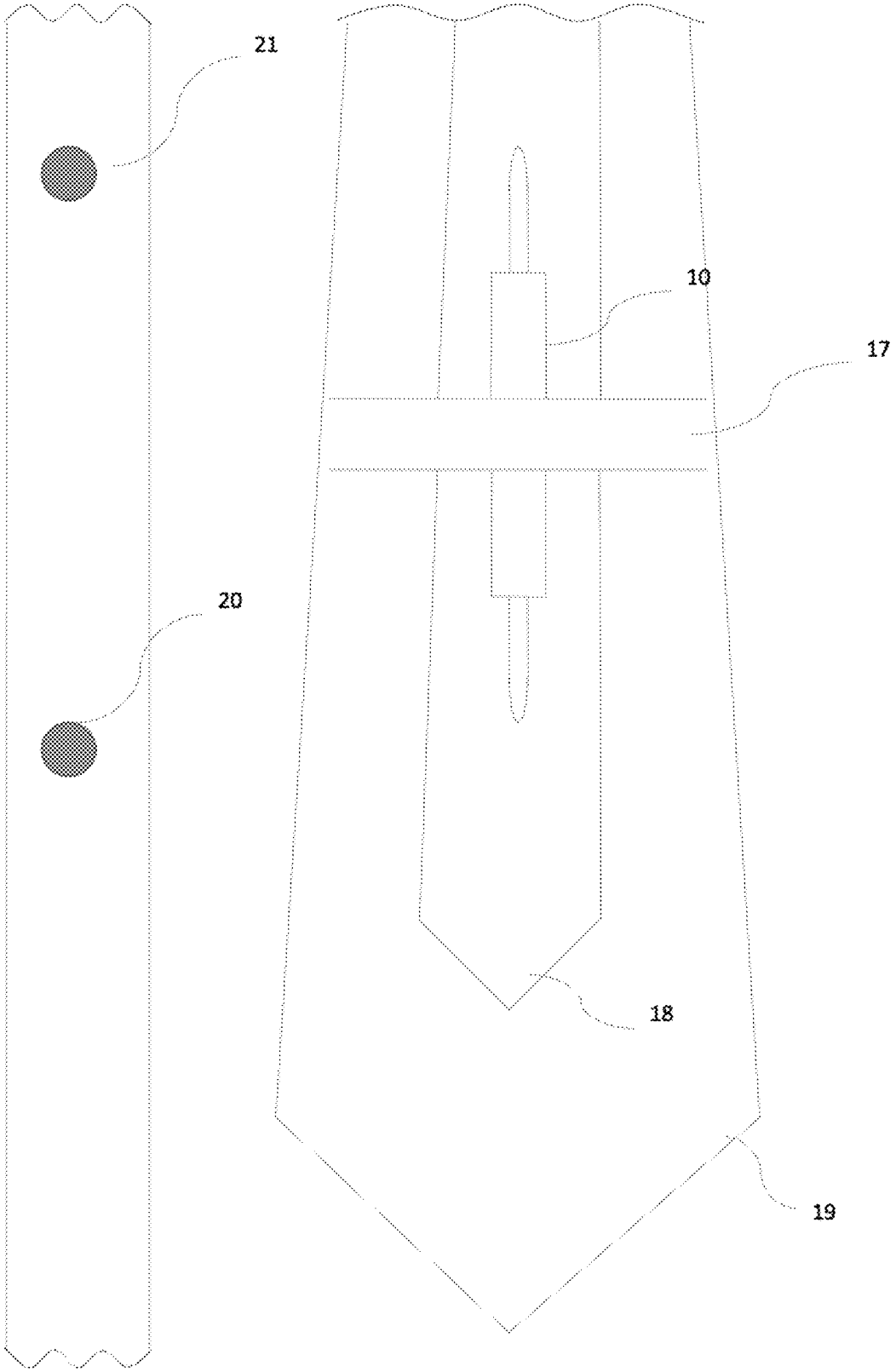
FIG. 1 shows a block diagram of how the method as a whole will function.
Figure 2:
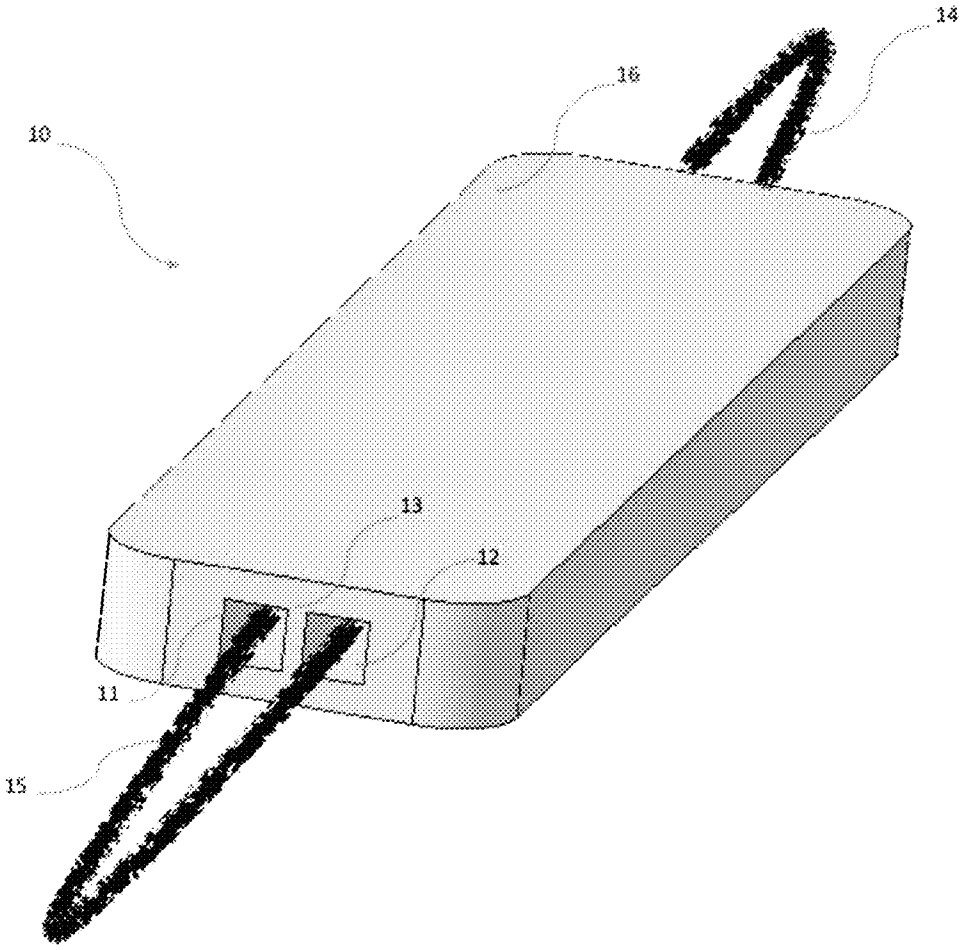
FIG. 2 shows a block diagram of the object with the flexible material loops protruding from it.

FIG. 1 shows a block diagram of the invention 10 and illustrates how the invention 10 interacts with a necktie 17, 18 and 19 when the method is in use. As seen in FIG. 2, the object 16 is depicted in a rectangular shape with rounded edges, but is generally designed in many different shapes and sizes. Such variations in shapes and sizes have no influence or impact on the purpose or result of the method. Instead, such variations in shapes and sizes are only ornamental designs.

The object's perforations 11 and 12 are equally divided by a wall 13. As seen in FIG. 2, the protruding flexible material 14 and 15 creates loops at both ends of the object along its widths.

As seen in FIG. 1, the invention 10 sits in a vertical manner along the length of a shirt. The invention 10 is placed through the necktie loop 17, which has the end result of the object resting between the necktie loop 17 and the narrow end taper of the necktie 18.

The flexible material loops 14 and 15 seen in FIG. 2 securely fasten around the two closest shirt buttons 20 and 21 seen in FIG. 1. As seen in FIG. 1, the closest loop created by the flexible material to a person's head is connected to the upper shirt button 21. Next, the closest loop created by the flexible material to a person's feet is connected to the lower shirt button 20.

This method ensures that the necktie is secure and aligned. Further, this method allows for the wide end taper of the necktie 19 to display its true character.

What is claimed is:

1. A method of securing and aligning a necktie on a shirt, comprising:

an object;

the object having a at each end of the object, the length being longer than the widths;

the object having a front and a back;

the object having a perforation within its center, extending the entire length of the object, connecting both widths of the object at their centers;

the perforation being fully enclosed within the object, except for at both widths of the object, where the perforation is open;

the perforation being evenly divided by a solid wall within an exact center of the perforation, thereby creating two distinct perforations, each connecting both widths of the object;

a flexible material;

the flexible material being inserted through one of the distinct perforations and extending beyond the length of the object;

a separate flexible material being inserted through the other one of the distinct perforations and extending beyond the length of the object;

ends of the flexible material and the separate flexible material being permanently connected to each other adjacent respective ones of the widths of the object;

the permanently connected flexible material and the separate flexible material create distinct loops protruding from the distinct perforations at each width of the object;

the loops protruding from the distinct perforations at each width of the object being of sufficient length to securely fasten to two shirt buttons, of which are the nearest two shirt buttons to where a necktie loop, located on a reverse side of a wide end taper of the necktie, naturally rests upon the shirt after a person completely assembles the necktie using a standard tying method;

the object, after being placed through the necktie loop and remaining in-between the necktie loop and the necktie, is connected to the two nearest shirt buttons using the loops, thereby securing and aligning the necktie to the shirt without the object being readily visible.

2. A method of securing and aligning a necktie on a shirt, comprising:

an object;

the object having a length and a width at each end of the object, the length being longer than the widths;

the object having a front and a back;

the object having a perforation within its center, extending the entire length of the object, connecting both widths of the object at their centers;

the perforation being fully enclosed within the object, except for at both widths of the object, where the perforation is open;

the perforation being evenly divided by a solid wall within an exact center of the perforation, thereby creating two distinct perforations, each connecting both widths of the object;

a flexible material;

the flexible material being inserted through both distinct perforations at one of the widths of the object and extending beyond the length of the object;

ends of the flexible material protruding from the opposite width of the object from where inserted being permanently connected to each other;

the permanently connected ends of the flexible material being hidden within one of the distinct perforations of the object;

the permanently connected flexible material creates distinct loops protruding from the distinct perforations at each width of the object;

the loops protruding from the distinct perforations at each width of the object being of sufficient length to securely fasten to two shirt buttons, of which are the nearest two shirt buttons to where a necktie loop, located on a reverse side of a wide end taper of the necktie, naturally rests upon the shirt after a person completely assembles the necktie using a standard tying method;

the object, after being placed through the necktie loop and remaining in-between the necktie loop and the necktie, is connected to the two nearest shirt buttons using the loops, thereby securing and aligning the necktie to the shirt without the object being readily visible.

* * * * *